United States Patent [19]

Kittell

[11] 3,950,890

[45] Apr. 20, 1976

[54] BALL BOUNCING DEVICE

[76] Inventor: David H. Kittell, 42 Ardsley Road, Stamford, Conn. 06906

[22] Filed: Apr. 10, 1975

[21] Appl. No.: 566,964

[52] U.S. Cl. ..... 46/45; 46/227

[51] Int. Cl.[2] ..... A63H 5/00

[58] Field of Search ..... 46/45, 47, 227, 232, 46/235

[56] References Cited

UNITED STATES PATENTS 3,783,550 1/1974 Andrews ..... 46/45

*Primary Examiner*—Louis G. Mancene
*Assistant Examiner*—Robert F. Cutting
*Attorney, Agent, or Firm*—Buckles and Bramblett

[57] ABSTRACT

A novelty device for sustainingly bouncing an object such as a ball. The cone of a loud-speaker is covered by a taut elastic diaphragm against which the object is bounced. When the object strikes the diaphragm, the speaker produces a small electrical pulse which is amplified and returned to the speaker. The amplified pulse is thereby acoustically coupled to the diaphragm which is snapped to restore sufficient energy to the object to overcome frictional losses.

10 Claims, 4 Drawing Figures

32
30
34
28
24
26
10
12
14

20
18
22
16
14

74
76
72
68
78
70

38
40
44
34
42
36
46
POWER SUPPLY 56
62
58
14
54
60
66
52
50
64
48
BOUNCE SUSTAINING CIRCUIT

BALL BOUNCING DEVICE

BACKGROUND OF THE INVENTION

This invention pertains to an apparatus for keeping an object, such as a ball, in a condition of sustained bouncing. It may be employed primarily for its novelty and entertainment effect. However, it may also be employed for other purposes, such as time keeping, as will be later explained.

An object will not continue bouncing in the absence of added energy, due to normal friction losses. Accordingly, it is a primary object of the present invention to provide an apparatus for restoring energy to such an object. Other objects are to provide such an apparatus wherein the means for replacing the energy are not readily apparent. Other objects, features, and advantages will become apparent from the following description and appended claims.

SUMMARY OF THE INVENTION

Apparatus for sustainingly bouncing an object which comprises an elastic diaphragm positioned to be deformed by the impact of the object and create an acoustic wave. A transducer is positioned to receive the wave and generate an electrical pulse responsive thereto. Means are provided for receiving and amplifying the pulse and exciting the transducer therewith to produce an acoustic wave directed to impinge upon the diaphragm to propel the object therefrom.

DESCRIPTION OF THE PREFERRED EMBODIMENTS

Figure 1:
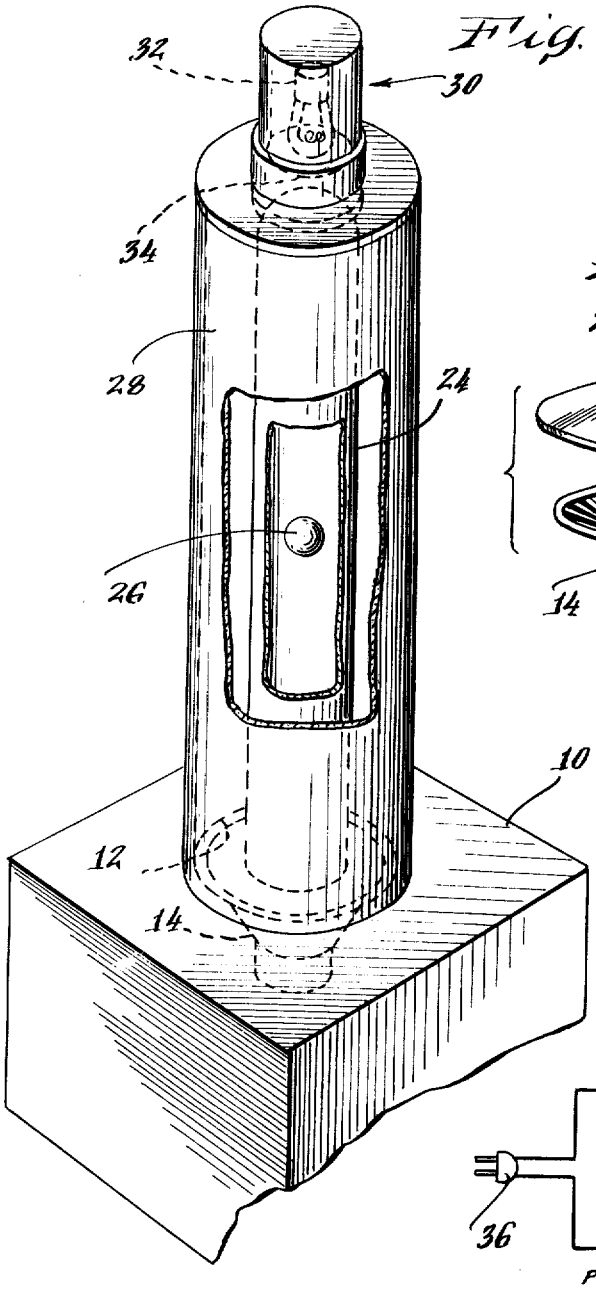
FIG. 1 is a perspective view of an apparatus in accordance with this invention, partially broken away to illustrate its internal construction.
Figure 2:
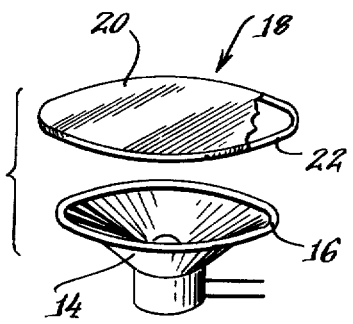
FIG. 2 is an exploded view of a speaker and diaphragm usable in the present invention.

With particular reference to FIG. 1, there is illustrated one embodiment of an apparatus embodying the present invention. It comprises a hollow, box-like base 10 whose top surface defines a central circular opening 12 below which is mounted a speaker 14. As shown in FIG. 2, the speaker 14 is conventional, but mounted on the flange 16 of its cone is a diaphragm 18. The diaphragm 18 comprises a film 20 stretched tautly over and secured to a wire ring 22. The film 20 may be of plastic, such as a polyester or cellophane, having a thickness of approximately 0.001 inch. However, many other materials would also be usable so long as they are relatively light weight and elastic. Mounted upon the surface of the diaphragm 18 is a transparent ball guide 24 for containing a bouncing ball 26. The ball guide 24 may be in the form of an inverted test tube or similar object. The transparent cylindrical housing 28 extends upwardly from the base surrounding the opening 12 and ball guide 24. It carries at its top an illumination assembly 30 which may contain a small light bulb 32 and a condensing lens unit 34.

Figure 3:
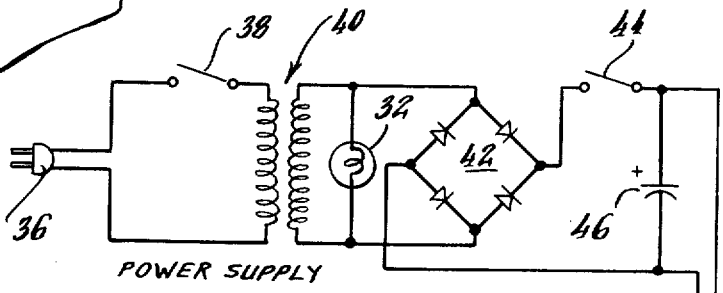
FIG. 3 is a schematic diagram of a circuit usable in the present invention.
Figure 3:
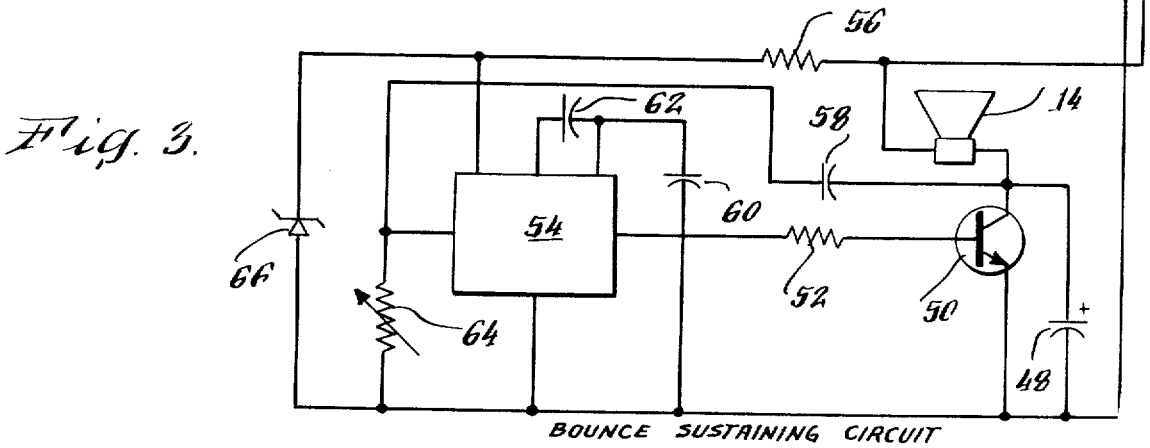

Housed within the base 10 is the electronic circuit of FIG. 3, which is energized from a conventional 115 VAC power source through a plug 36 and switch 38.

The power source voltage is connected across the primary of a step down transformer 40. Across the secondary of the transformer is connected the light bulb 32 and a full wave rectifier 42. The output of rectifier 42 is connected through a switch 44 across a smoothing capacitor 46.

The output of the power supply is connected to the bounce sustaining circuit which includes the speaker 14 connected in series with the parallel combination of capacitor 48 and the collector-emitter circuit of NPN transistor 50. The base of transistor 50 is connected through resistor 52 to an integrated circuit 54 which contains a Schmitt trigger and a monostable pulse generator. Also connected into the circuit as illustrated are a resistor 56, capacitors 58, 60, 62, a variable resistor 64, and a zener diode 66.

While the circuit may be modified substantially by those skilled in the art, the following components are representative of one embodiment of the invention;

| | | |
|---|---|---|
| Transformer | 40 | 115 : 6.3 V. |
| Rectifier | 42 | 1 amp., 50 V. |
| Capacitor | 46 | 2200 MFD, 12 V. |
| Capacitor | 48 | 10 MFD, 15 V |
| Capacitor | 58 | 10 MFD, 15 V |
| Capacitor | 60 | .05 MFD, 50 V |
| Capacitor | 62 | 1 MFD, 15 V |
| Speaker | 14 | 8 ohms |
| Transistor | 50 | NPN silicon |
| Resistor | 52 | 330 ohms |
| Resistor | 56 | 82 ohms |
| Resistor | 64 | 2500 ohms |
| Diode | 66 | Zener, 6 V, .25 W |
| Circuit | 54 | National Semiconductor (Monostable 74121) |

With both switches 38, 44 closed, the object (such as steel ball 26) which is to be bounced, is dropped against the surface of the diaphragm 18 by any suitable means, such as shaking. When the ball strikes the diaphragm, a small voltage pulse is generated and applied via capacitor 58 to the input terminal of the integrated circuit 54. The resistor 64 is adjustable so that the induced voltage pulse from the speaker can be matched to the sensitivity of the Schmitt trigger. A voltage pulse whose duration is established by capacitor 62 is generated by the integrated circuit when the Schmitt trigger's threshold voltage is matched or exceeded. This output pulse is applied through resistor 52 to the base of the transistor 50 which, in turn, amplifies the pulse and applies it to the speaker 14. The pulsed speaker creates an abrupt acoustic snap of the diaphragm 18 and thus to the ball, thereby completing the bounce cycle. The resistor 56 and the zener diode 66 regulate the voltage which is applied to the integrated circuit. The capacitor 60 inhibits spurious oscillations and capacitor 48 eliminates radio frequency interference and is also selected so as to modify the sound made by the speaker.

Figure 4:
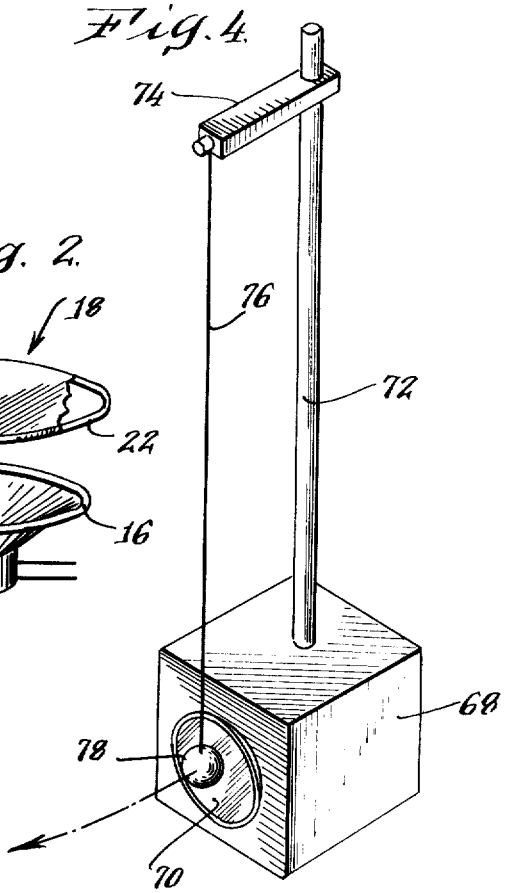
FIG. 4 is a perspective view of a modified form of the apparatus of the invention.

In FIG. 4, there is illustrated a modified form of the apparatus which utilizes the same electronic circuitry and speaker-diaphragm arrangements. However, in this modification the base 68 holds the speaker with its cone and diaphragm vertical. An upright post 72 and arm 74 support a cord 76 to which is secured a ball 78. This modification functions in a manner similar to that previously described, except that the ball now swings in an arc as shown by the arrows. As the frequency of oscillation is maintained by the weight of the ball 78 and the length of the cord 76, this modification might be employed as the escapement mechanism for a clock.

It will be apparent to those skilled in the art that a number of variations and modifications may be made in this invention without departing from its spirit and scope. For example, the lighting system of the FIG. 1 version is primarily decorative in nature and may be omitted. The housing 28 serves to muffle sound from the speaker but is not a necessary element. Even the ball guide 24 may be dispensed with in some designs. Accordingly, the foregoing description should be taken as illustrative, rather than limiting. This invention is limited only by the scope of the following claims.

I claim:

1. Apparatus for sustainingly bouncing an object which comprises: an elastic diaphragm positioned to be deformed by the impact of said object and create an acoustic wave; a transducer positioned to receive said wave and generate an electrical pulse responsive thereto; and means for receiving and amplifying said pulse and exciting said transducer therewith to produce an acoustic wave directed to impinge upon said diaphragm to propel said object therefrom.

2. The apparatus of claim 1 wherein said transducer comprises a loud-speaker.

3. The apparatus of claim 2 wherein said diaphragm comprises a stretched membrane across the cone of said speaker.

4. The apparatus of claim 3 wherein said membrane is positioned horizontally to vertically bounce said object therefrom.

5. The apparatus of claim 3 wherein said membrane is positioned at an angle from the horizontal to bounce a suspended object therefrom.

6. The apparatus of claim 5 wherein said membrane is positioned in a substantially vertical plane.

7. The apparatus of claim 1 wherein said diaphragm comprises a stretched plastic membrane.

8. Pendulum apparatus which comprises: means for suspendingly supporting a swinging object; an elastic diaphragm positioned to be impacted by said object at one end of its swing and create an acoustic wave; a transducer positioned to receive said wave and generate an electrical pulse responsive thereto; and means for receiving and amplifying said pulse and exciting said transducer therewith to produce an acoustic wave directed to impinge upon said diaphragm to propel said object therefrom.

9. The apparatus of claim 8 wherein said transducer comprises a loud-speaker.

10. The apparatus of claim 9 wherein said diaphragm comprises a stretched membrane across the cone of said speaker.

* * * * *